US008436560B2

(12) United States Patent
Waters et al.

(10) Patent No.: US 8,436,560 B2
(45) Date of Patent: May 7, 2013

(54) SYSTEM AND METHOD FOR ACTUATING A DISPENSING DEVICE USING A LINEAR MOTOR

(75) Inventors: John J. Waters, West Deptford, NJ (US); Thomas J. Speelman, Titusville, NJ (US)

(73) Assignee: InnovaSystems, Inc., Moorestown, NJ (US)

( * ) Notice: Subject to any disclaimer, the term of this patent is extended or adjusted under 35 U.S.C. 154(b) by 558 days.

(21) Appl. No.: 12/783,552

(22) Filed: May 19, 2010

(65) Prior Publication Data

US 2011/0066295 A1 Mar. 17, 2011

Related U.S. Application Data

(60) Provisional application No. 61/179,719, filed on May 19, 2009.

(51) Int. Cl.
*H02K 41/02* (2006.01)
*B67D 7/62* (2010.01)
*G05D 7/06* (2006.01)

(52) U.S. Cl.
USPC ..... 318/135; 318/687; 222/52; 222/63; 700/283

(58) Field of Classification Search ..... 318/38, 318/135, 437, 687; 222/1, 52, 63, 162, 504, 222/649; 700/283; 239/407, 412
See application file for complete search history.

(56) References Cited

U.S. PATENT DOCUMENTS

| | | | | |
|---|---|---|---|---|
| 3,228,609 | A * | 1/1966 | Edelstein et al. | 239/70 |
| 5,038,972 | A * | 8/1991 | Muderlak et al. | 222/25 |
| 5,397,028 | A * | 3/1995 | Jesadanont | 222/1 |
| 7,278,555 | B2 * | 10/2007 | McGill | 222/326 |
| 2004/0231667 | A1 * | 11/2004 | Horton et al. | 128/202.13 |
| 2005/0022806 | A1 * | 2/2005 | Beaumont et al. | 128/200.14 |
| 2005/0247312 | A1 * | 11/2005 | Davies | 128/203.15 |
| 2009/0045220 | A1 * | 2/2009 | Helf et al. | 222/52 |

* cited by examiner

*Primary Examiner* — Eduardo Colon
(74) *Attorney, Agent, or Firm* — Kenealy Vaidya LLP

(57) ABSTRACT

A system for actuating a dispensing device includes an apparatus for holding and actuating the dispensing device that includes a linear motor including a stator component and a forcer component and a frame that orients components of the linear motor relative to each other and relative to the dispensing device. The system further includes a controller configured to control the linear motor and a device that interfaces with the controller and provides a user interface for control of the system. The controller is configured to generate control signals that cause the apparatus to perform at least one actuation cycle specified by an operator. The device that communicates with the controller generates a command sequence based on the at least one actuation cycle specified and the controller generates signals based on the command sequence that cause the system to perform the at least one actuation cycle.

21 Claims, 8 Drawing Sheets

SYSTEM AND METHOD FOR ACTUATING A DISPENSING DEVICE USING A LINEAR MOTOR

CROSS REFERENCE TO RELATED APPLICATIONS

This application claims priority under 35 U.S.C. 119(e) to U.S. Provisional Application No. 61/179,719 filed on May 19, 2009, the disclosure if which is also incorporated herein by reference.

BACKGROUND

1. Field

The present disclosure relates to devices, systems, and processes for actuating devices that generate a spray and testing the operational characteristics of such devices.

2. Description of the Related Art

Systems and processes are known for actuating devices that generate a spray and testing various characteristics of the spray that is generated. Devices administering various compounds (e.g. medicinal compounds) in the form of a spray include, for example, nasal spray devices (NSP) and metered dose inhalers (MDI).

Conventional systems for actuating a spray device to test various characteristics and parameters of the spray employ a rotary motor for actuating the device. The rotary motor includes a load cell that is required to determine the force applied to actuate the device. In these rotary motor actuated systems which have no load cell, several variables need to be initially determined in order to determine the actuating force applied. For instance, an rpm of the rotary motor must first be determined. Based on this determination, a torque of the rotary motor is determined, and subsequently a velocity (rate of actuation) or force of actuation can be determined.

SUMMARY

According to an aspect of the disclosed subject matter, a system for actuating a dispensing device includes an apparatus for holding and actuating the dispensing device that includes a linear motor including a stator component and a forcer component and a frame that orients the components of the linear motor relative to each other and relative to the dispensing device, a controller configured to control the linear motor, and a device that communicates with the motor controller and provides a user interface for control of the system. The controller is configured to generate control signals that cause the apparatus to perform at least one actuation cycle specified by an operator through the user interface provided by the device that communicates with the controller.

The system in accordance with the previously described aspect of the present disclosure utilizes a linear actuator to actuate the dispensing device. Use of a linear actuator provides distinct advantages over conventional configurations that employ a rotary motor to actuate the dispensing device. A linear actuated system does not require a load cell to determine the actuation force applied to actuate the dispensing device. As such, the complicated determination of variables required to determine the actuating force applied by a rotary motor is not required. Instead, an electrical current applied to the linear motor can be monitored and the actuation force can be determined based on direct proportionality between the electrical current applied to the linear motor and the actuation force. The use of a linear motor provides numerous advantages, including reduced maintenance, high reliability, reduced part count in the actuator (no belts, gears, pulleys), zero backlash, high stiffness, fast settling time, high positional accuracy, higher and smoother velocities and accelerations, application of a direct force and a compact assembly.

According to an aspect of the disclosed subject matter, the device that communicates with the controller generates a command sequence based on an actuation cycle specified by the operator, sends the command sequence to the controller, and the controller generates control signals based on the command sequence that cause the apparatus to perform the actuation cycle. The actuation cycle includes a staging phase during which the forcer component is brought into contact with the dispensing device and the dispensing device is brought to a staging position, an actuation phase during which an actuation force is applied by the forcer component to the dispensing device in a controlled manner, a holding phase during which the dispensing device is maintained in an actuated position for a period of time specified by the operator, and a release phase during which the actuation force applied to the dispensing device is removed such that the dispensing device moves from the actuated position to the staging position.

According to another aspect of the disclosed subject matter, the operator may specify a plurality of actuation cycles. The controller generates control signals to cause the system to perform the plurality of actuation cycles. According to this aspect of the disclosed subject matter, the controller causes the apparatus to perform the staging phase only for a first actuation cycle of the plurality of actuation cycles. In addition, the controller generates a control signal to cause the system to perform an inter-spray delay phase for each of the plurality of actuation cycles subsequent to the first actuation cycle. During the inter-spray delay phase, the dispensing device remains in the staging position for a period of time specified by the operator prior to initiation of a succeeding actuation cycle.

According to another aspect of the disclosed subject matter, an actuation cycle specified by the operator may include a velocity profile or a force profile. The operator may specify any combination of velocity or force profiles in a series of actuation cycles. A force profile specifies at least one of an actuation rate of application force and release rate of force for an actuation cycle. A force profile specifies at one of an actuation force and a release force for an actuation cycle.

According to another aspect of the disclosed subject matter, a velocity profile may be a constant velocity profile in which at least one of the actuation velocity and the release velocity is substantially constant for a substantial portion of at least one of the actuation phase and the release phase of an actuation cycle except for short acceleration and deceleration periods at the start and end of the phases.

According to another aspect of the disclosed subject matter, the velocity profile includes a series of velocity steps (alternately, this could be one step) specified by the operator such that the dispensing device is actuated at a specific velocity over an actuation distance specified by the operator for each of the velocity steps until the dispensing device reaches the actuated position and the motion ceases.

A system according to a previously disclosed aspect of the present disclosure may further include a linear encoder measures displacement which is in turn used to determine at least one of an actuation velocity and a release velocity such that the controller generates control signals that control at least one of an actuation velocity and a release velocity of the dispensing device in accordance with the velocity profile based on the velocity measured by the linear encoder.

According to another aspect of the disclosed subject matter, an actuation profile may be a force profile that specifies a linearly increasing force to be applied to the dispensing device during the actuation phase until an actuation distance specified by the operator is reached or the dispensing device reaches an end of mechanical travel. A maximum force can be specified by the operator to protect the device.

According to another aspect of the disclosed subject matter, an actuation profile may be a force profile that specifies a linearly decreasing force to be applied to the dispensing device during the release phase until the dispensing device reaches the staging position. It should be noted that the acceleration and deceleration parameters can be controlled by the operator (operator specified).

According to an aspect of the disclosed subject matter, the actuation force or release force applied in accordance with a force profile may be determined in various ways. For example, a system according to a previously disclosed aspect of the present disclosure may further comprise a strain gauge and an amplifier that operate together to measure the force applied to the dispensing device. In addition, a system according to a previously disclosed aspect of the present disclosure may further comprise an ammeter that measures the current required by the linear motor, wherein the force applied to the dispensing device is determined based on the measured current.

According to an aspect of the disclosed subject matter, the dispensing device may generally be actuated over an actuation range of 0 to about 50 mm. The dispensing device may be a nasal spray pump or a metered dose inhaler. If the dispensing device is a nasal spray pump, the pump may commonly be actuated over an actuation range of about 4 mm to about 7 mm. If the dispensing device is a metered dose inhaler, the inhaler may commonly be actuated over an actuation range of about 2 mm to about 4 mm.

According to an aspect of the disclosed subject matter, the device that communicates with the controller is a processing device, such as a personal computer. The processing device may have various peripheral devices attached thereto that enable a user interface through which an operator may specify various inputs such as one or more actuation cycles, a period of time during which the dispensing device is maintained in a actuated position during the holding phase, and the actuation distance at which an actuation force applied to the dispensing device in accordance with a force profile ceases to increase. The peripherals may include a mouse, keyboard, and display that allow an operator to enter parameters through the user interface as well as receive and analyze data gathered from operation of the system. The personal computer may be connected to the controller through a serial communications port such as an RS-232 or an ethernet connection.

According to another aspect of the disclosed subject matter, a method for actuating a dispensing device includes completing an actuation cycle specified by an operator. The actuation cycle includes a staging step during which the dispensing device is contacted by a linear actuator and brought to a staging position, an actuation step during which the dispensing device is actuated by the linear actuator, a holding step during which the dispensing device is maintained in an actuated position for a period of time determined by an operator, and a release step during which an actuation force applied by the linear actuator is removed so as to allow the dispensing device to move from the actuated position to the staging position.

According to another aspect of the disclosed subject matter, a method for actuating a dispensing device includes completing a plurality of actuation cycles specified by an operator. The plurality of actuation cycles includes a first actuation cycle and successive actuation cycles. The initial actuation cycle includes a staging step during which the dispensing device is contacted by a linear actuator and brought to a staging position, an actuation step during which the dispensing device is actuated by the linear actuator, a holding step during which the dispensing device is maintained in an actuated position for a period of time specified by the operator, and a release step during which an actuation force applied to the dispensing device by the linear actuator is removed so as to allow the dispensing device to move from the actuated position to the staging position or slightly below the staging position (for example, 1 mm below the staging position). Each successive actuation cycle includes an inter-spray delay step during which the dispensing device is maintained in the staging position for a period of time specified by the operator, an actuation step during which the dispensing device is actuated by the linear actuator, a holding step during which the dispensing device is maintained in an actuated position for a period of time specified by the operator; and a release step during which an actuation force applied to the dispensing device by the linear actuator is removed so as to allow the dispensing device to move from the actuated position to the staging position.

Another aspect of the disclosed embodiments includes a pass/fail criteria which regulates certain parameters during the compression phase. For example, a "travel" parameter checks that the actuation travel falls within the tolerance limits. A "velocity" parameter checks that velocity (after acceleration) falls within tolerance limits. A "force Integration (energy)" measurement takes the sum of the (force*movement) during a certain time period during the actuation phase. The operator can also enter a tolerance value in percent for each of three data fields as follows: travel limit ±%, using "stroke length" or "minimum travel" as a target (center) value; velocity ±%, using actuation velocity as target (center) value; and energy ±%, using operator supplied target (center) value.

According to another aspect of the disclosed subject matter, a computer-readable recording medium stores a program for causing a controller to perform at least one actuation cycle specified by an operator for actuating a dispensing device. The program includes instructions for performing a command sequence. The command sequence includes a command to initialize an actuation cycle counter, and a command to perform a staging step during which the dispensing device is contacted by a linear actuator and brought to a staging position. If more than one actuation cycle is specified by the operator, the staging step is performed for only the first actuation cycle (in an alternate embodiment, the staging step can be performed after each cycle). A determination as to whether the actuation cycle counter equals the number of actuation cycles specified by the operator is then made. If the actuation cycle counter does not equal the number of actuation cycles, the command sequence further includes a command to perform an inter-spray delay step during which the dispensing device is maintained in the staging position for a period of time specified by the operator, a command to perform an actuation step during which the dispensing device is actuated by the linear actuator, a command to perform a holding step during which the dispensing device is maintained in an actuated position for a period of time determined by an operator; and a command to perform a release step during which an actuation force applied by the linear actuator is removed so as to allow the dispensing device to move from the actuated position to the staging position.

It should also be understood that the term dispensing device as used above may refer to a variety of devices which may be used to dispense various compositions, including but not limited to medicines, as a well as a variety of gels, lotions, creams, etc. For example, the dispensing device may be an aerosol spray device.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Figure 1:
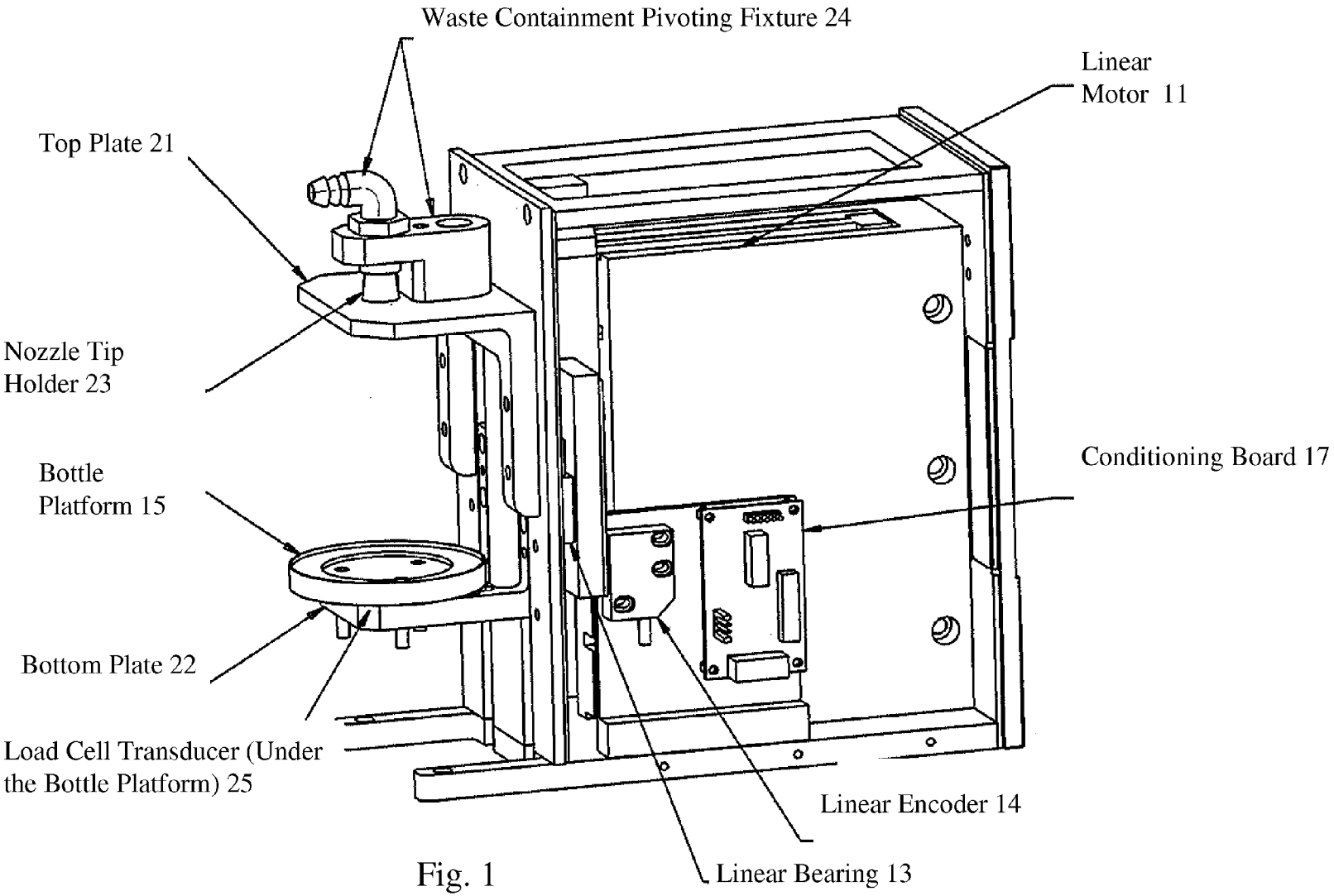
FIG. 1 is a perspective view of an apparatus for actuating a dispensing device in accordance with aspects of the present disclosure.
Figure 2:
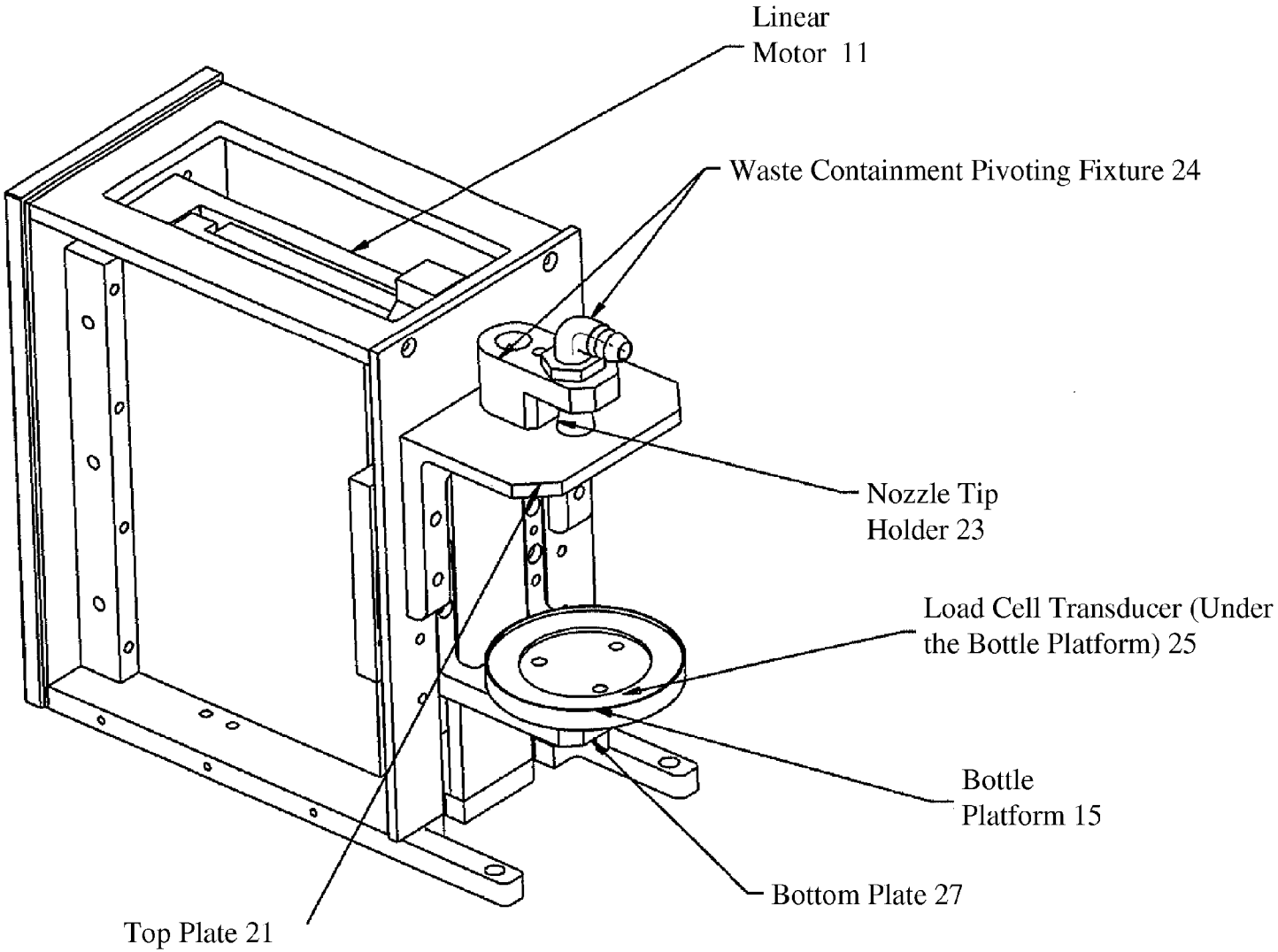
FIG. 2 is another perspective view of an apparatus for actuating a dispensing device in accordance with aspects of the present disclosure.
Figure 3:
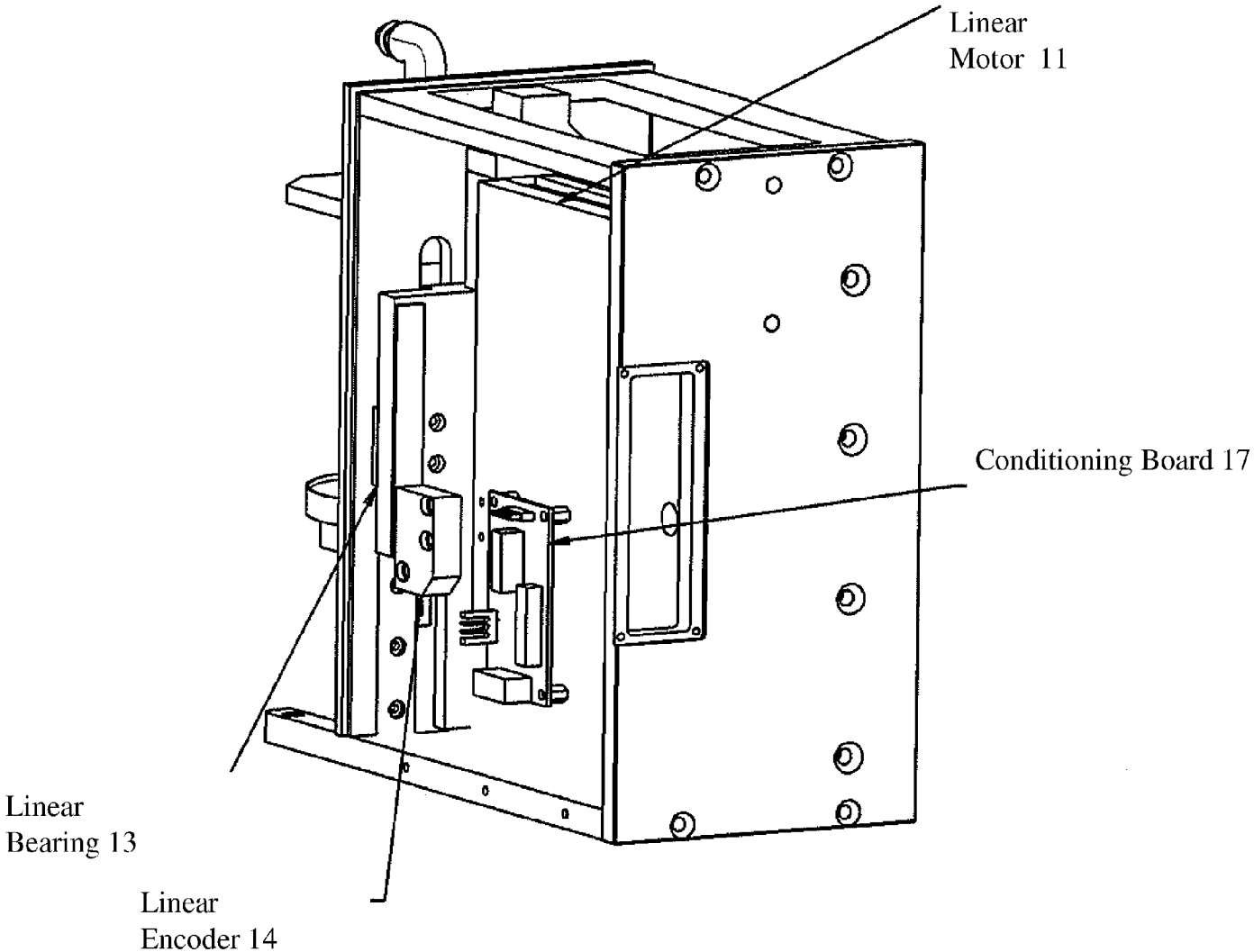
FIG. 3 is another perspective view of an apparatus for actuating a dispensing device in accordance with aspects of the present disclosure.

FIGS. 1-3 depict various perspective views of an apparatus for holding and positioning and actuating a dispensing device, such as an aerosol spray device, in accordance with embodiments of the present disclosure. Referring to FIG. 1, the apparatus 10 includes a frame and a linear motor 11. The linear motor 11 includes a bottle platform 15, which will be described in further detail later. The frame includes a top plate 21, a bottom plate 22, a nozzle tip holder 23, and a waste containment pivoting fixture 24. The apparatus 10 further includes a linear bearing 13, a linear encoder 14, and a conditioning board 17. The waste containment pivoting fixture 24 permits redirecting the aerosol spray emitted from the aerosol spray device during actuation to allow for collection or disposal. The apparatus may optionally include a load cell transducer 25 that is positioned below the bottle platform 15. The load cell transducer 25 includes at least one strain gauge and an amplifier that operate together to measure an actuation force applied to the aerosol spray device. In particular, the actuation force applied to the aerosol spray device produces a deformation in the at least one strain gauge, which converts the deformation to an electrical signal output. The electrical signal output is then amplified by the amplifier and the force is calculated from this amplified electrical signal output.

The apparatus is designed to hold an aerosol spray device, such as a nasal spray pump or a metered dose inhaler, and to actuate the device by applying an actuation force along a center axis of the device that runs from a bottom surface of the device through the nozzle tip of the device. A typical nasal spray pump includes a nozzle tip, a pump, and a bottle. The nozzle tip is held stationary by the nozzle tip holder and the pump is actuated by the linear motor. The apparatus is capable of holding and positioning aerosol spray devices of various dimensions. The various components of the aerosol spray device should have dimensions so as to allow easy insertion and removal of the device from the apparatus.

Figure 4:
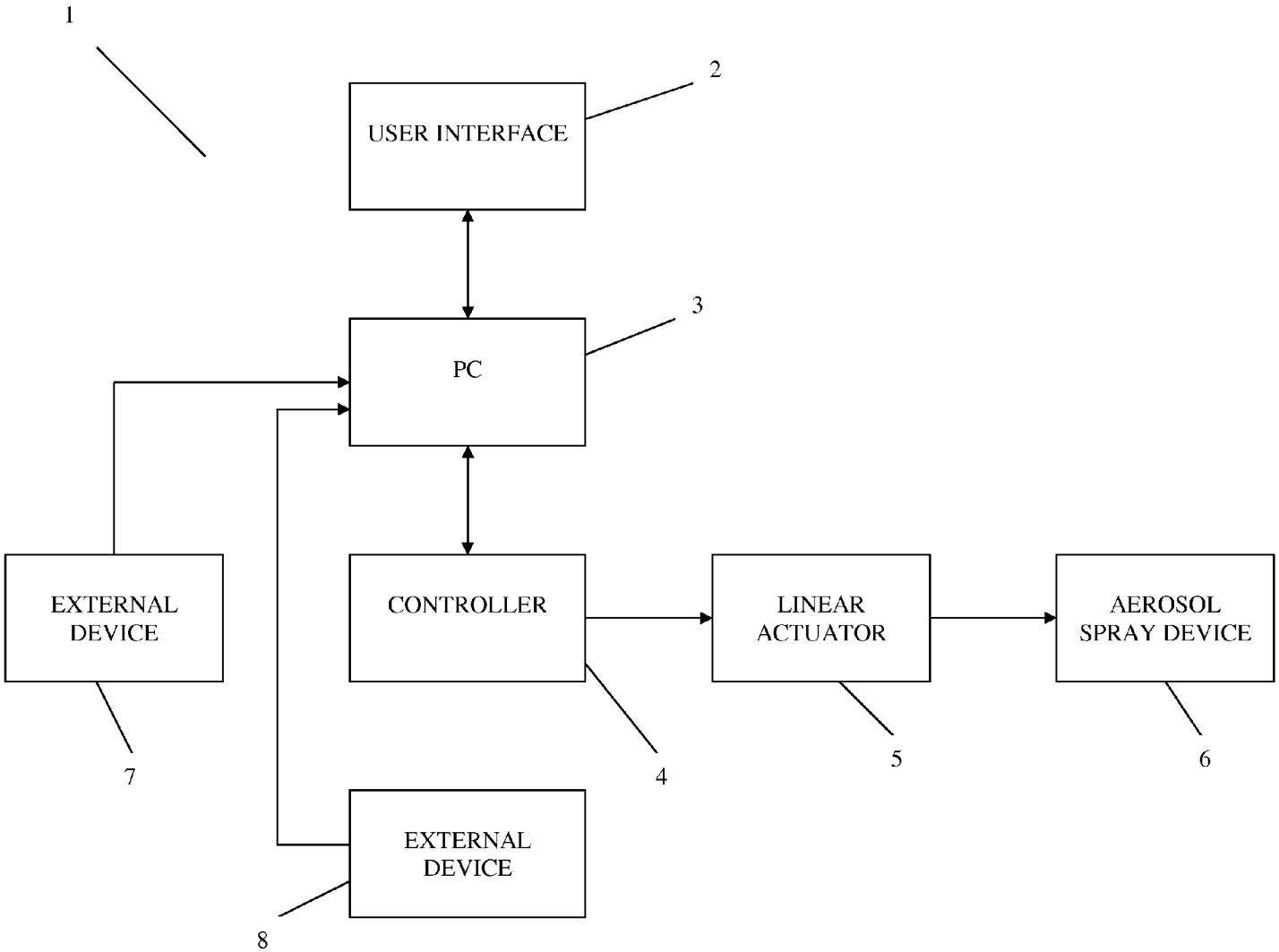
FIG. 4 is a schematic of a system for actuating a dispensing device in accordance with aspects of the present disclosure.

The apparatus depicted in FIGS. 1-3 is part of a system in accordance with aspects of the present disclosure that will hereinafter be described in greater detail with reference to FIGS. 4 and 5. FIG. 4 depicts a schematic diagram of a system in accordance with aspects of the present disclosure. The system 1 includes a personal computer 3 and a controller 4. The controller 4 may be an electronic control unit that includes one or more processors. The personal computer 1 is connected to various peripheral devices (not shown) that provide a user interface 2 to an operator of the system. The personal computer 1 is connected to the controller 4 by way of a serial communications port such as a DB-9 connector that supports RS-232 signal levels or an ethernet connection. The system 1 allows for bi-directional communication between the personal computer 3 and the operator through the user interface 2 as well as bi-directional communication between the personal computer 3 and the controller 4. The controller 4 receives command sequences from the personal computer 3 that correspond to at least one actuation cycle specified by an operator through the user interface 2. The controller 3 then generates control signals based on the command sequences and controls the linear actuator 5 to perform the at least one actuation cycle specified by the operator in accordance with the velocity profile and/or force profile specified by the operator for the at least one actuation cycle. The controller 4 collects data during each actuation of the aerosol spray device and sends the data to the personal computer 3, which then makes the data available to the operator for observation and analysis through the user interface 2.

The system according to aspects of the present disclosure may be used in combination with external accessory devices that allow for droplet size analysis, spray pattern analysis, plume geometry analysis, dose weight analysis and/or content or dose uniformity. For example, the system may be used in combination with a particle sizer that emits a laser beam that intersects a geometric plane of the aerosol spray emitted during actuation of the aerosol spray device. The particle sizer provides data regarding the size of droplets contained in the aerosol spray which is then sent to the personal computer 3. An operator may then analyze and observe the droplet size data by way of the user interface 2.

External devices for testing and analyzing the spray pattern and geometric characteristics of the aerosol spray generated during actuation of the aerosol spray device may also be used in combination with a system of the present disclosure. For example, a TLC plate holder may be connected to the system. The TLC plate holder maintains a TLC plate a predetermined distance from the nozzle tip of the aerosol spray device. The TLC plate is then irradiated with UV light which causes a coating thereon to fluoresce and reveals the spray pattern deposited on the TLC plate by the aerosol spray. Various characteristics of the spray pattern are then measured and the acquired data is sent to the personal computer which presents the data to the operator for observation and analysis through the user interface. As an alternative to the TLC plate configuration, the system according to aspects of the present disclosure may operate in combination with a system that includes an illuminator that illuminates either a transverse cross-sectional plane or a longitudinal cross-sectional plane of the aerosol spray and an imaging device that acquires data representative of an interaction between the illumination and the aerosol spray along the illuminated geometric plane. The data provides information about both geometric and pattern characteristics of the aerosol spray.

In addition, a dose weight testing system may be used in combination with a system of the present disclosure. The aerosol spray emitted during actuation of the aerosol spray device may be collected for testing purposes or may be discarded.

Operation of the system depicted in FIG. 4 will now be described in greater detail with reference to FIG. 5. In step 100, an operator specifies a system run that includes one or more actuation cycles to be performed by the system. More specifically, the operator provides various inputs to the personal computer through the user interface that define the system run. An actuation cycle includes a staging phase during which the forcer component of the linear motor is brought into contact with the aerosol spray device and the aerosol spray device is brought to a staging position, an actuation phase during which an actuation force is applied by the forcer component to the aerosol spray device in a controlled manner, a holding phase during which the aerosol spray device is maintained in an actuated position for a period of time specified by the operator, and a release phase during which the actuation force applied to the aerosol spray device is removed such that the aerosol spray device moves from the actuated position to the staging position or just slightly below the staging position. If more than one actuation cycle is specified by the operator, the staging phase may in one embodiment be performed for only the first actuation cycle (alternately, for each actuation cycle). In addition, if more than one actuation cycle is specified, an inter-spray delay phase is performed for each actuation cycle subsequent to the first actuation cycle. During the inter-spray delay phase, the aerosol spray device remains in the staging position for a period of time specified by the operator prior to initiation of a succeeding actuation cycle.

In step 100, the operator specifies various parameters that define a system run. The system run includes one or more actuation cycles to be performed by a system in accordance with aspects of the present disclosure. The operator first specifies an alphanumeric name that uniquely identifies the system run. The operator then inputs a number of actuation cycles to be performed in the run, and for each of the actuation cycles, the operator specifies various parameters including an actuation velocity profile, a hold time, and a release velocity profile. In addition, if the operator specifies more than one actuation cycles, the operator inputs an additional parameter that specifies an inter-spray delay time.

The operator may specify an actuation velocity profile, a hold time, and a release velocity profile that applies to all actuation cycles in the run. Alternatively, the operator may specify different actuation velocity profiles, hold times, and release velocity profiles for one or more of the actuation cycles. In addition, the operator may specify a single inter-spray delay time that applies to each actuation cycle after the first actuation cycle, or the operator may specify a different inter-spray delay time for one or more actuation cycles subsequent to the first actuation cycle.

In addition to the parameters discussed above, the operator may also specify a trigger signal delay time that specifies a period of time between the start of an actuation cycle and the generation of an actuation cycle begin signal. An actuation cycle begin signal is generated by the controller to synchronize the operation of an external device with a particular point during the actuation of the aerosol spray device. In addition, various types of information are associated with the system run such as date and time of last modification, user name of last operator to modify the system run, date and time of approval of system run, etc. When the system run is defined by the operator it is flagged as non-approved. Non-approved system runs can only be initiated by authorized operators with system run editing permission. Approved methods are available to all operators.

After the operator inputs the various parameters that define a system run, in step 101, the personal computer generates a command sequence based on the system run specified by the operator. The command sequence is a series of commands that instructs the controller to control the apparatus depicted in FIGS. 1-3 to perform the one or more actuation cycles specified by the operator. In step 102, the controller receives the command sequence from the personal computer and generates control signals based on the command sequence that control the apparatus to perform the one or more actuation cycles. In step 103, the controller controls the apparatus in accordance with the generated control signals to perform the one or more actuation cycles specified by the operator.

In step 104, various externals devices connected to the system generate data from the aerosol sprays produced by the one or more actuation cycles. In step 105, the data generated by the external devices as well as data acquired by the controller are transmitted to the personal computer. The data is then presented to an operator through the user interface for analysis and observation.

According to an aspect of the disclosed subject matter, a particular actuation cycle specified by the operator may include a velocity profile or a force profile. A single velocity or force profile may apply to all actuation cycles specified by the operator, or the operator may specify any combination of different velocity or force profiles for one or more of the actuation cycles. A velocity profile specifies at least one of an actuation velocity and a release velocity corresponding to the actuation and release phases. A force profile specifies a linearly increasing force to be applied during the actuation phase and/or a linearly decreasing force to be applied during the release phase.

When defining a system run, an operator may provide an actuation velocity and a release velocity as inputs. The actuation velocity and the release velocity are typically selected from a range of about 10 mm/sec to about 100 mm/sec in 1 mm/sec increments. As discussed above, the operator may select a single actuation velocity and release velocity for all actuation cycles, or the operator may choose to input different actuation velocities and/or release velocities to be applied during one or more of the specified actuation cycles.

A velocity profile may be a constant velocity profile in which at least one of an actuation velocity and a release velocity is substantially constant for a substantial portion of the actuation and release phases except for short acceleration and deceleration periods at the start and end of the phases. If the velocity profile is a constant velocity profile, the aerosol spray device will be actuated and/or released at the operator-specified actuation and release velocities, respectively, for the actuation cycle that the velocity profile is associated with.

Alternately, the velocity profile may include a series of velocity steps specified by the operator such that the aerosol spray device is actuated at a specific velocity over a distance specified by the operator for each of the velocity steps. Such a velocity profile may also include a series of velocity steps specified by the operator for releasing the aerosol spray device from the actuated position during performance of the release phase.

During performance of the one or more actuation cycles specified by the operator, the actuation velocity and release velocity are typically maintained within 1 mm/sec of the actuation and release velocities specified by the operator. That is, the actual actuation and release velocities differ from the operator-specified actuation and release velocities by less than approximately 1 mm/sec.

A system according to aspects of the present disclosure may further include a linear encoder that measures at least one of an actuation velocity and a release velocity. The controller generates control signals that control at least one of the actuation velocity and the release velocity in accordance with the velocity profile based on the velocity measured by the linear encoder. In addition, the velocity measurements calculated based upon the displacement measured by the linear encoder are sent to the personal computer, which then generates plots of displacement vs. time for the actuation and release phases of an actuation cycle. The plots are then presented to the operator through the user interface for observation and analysis. These plots will be described in greater detail later through reference to FIGS. 7*a*-7*b* and 8*a*-8*b*.

An actuation cycle specified by an operator may also include a force profile that specifies a linearly increasing force to be applied during the actuation phase. The linearly increasing force is applied until an actuation distance specified by the operator is reached or the aerosol spray device reaches an end of mechanical travel. In addition, the force profile may also specify a linearly decreasing force to be applied to the aerosol spray device during the release phase until the staging position is reached.

The actuation or release force applied in accordance with a force profile may be monitored in various ways. For example, a system according to aspects of the present disclosure may further comprise a load cell transducer that includes at least one strain gauge and an amplifier that operate together to measure the force applied to the aerosol spray device. In particular, as shown in FIGS. 1 and 2, the load cell transducer 25 is disposed under the bottle platform 15 and measures an actuation force applied to the aerosol spray device during the actuation phase and/or a force applied during the release phase. In particular, the actuation force applied to the aerosol spray device produces a deformation in the at least one strain gauge, which converts the deformation to an electrical signal output. The electrical signal output is then amplified by the amplifier and the force is calculated from this amplified electrical signal output.

Alternatively, the system may further comprise an ammeter that measures a current generated by the linear motor. The force applied to the aerosol spray device during the actuation phase and/or the release phase may then be determined based on a direct proportionality between the measured current and the force.

In addition, the force measurements obtained by the load cell transducer or calculated based on the electrical current applied to the linear motor are sent to the personal computer, which then generates plots of force vs. time for the actuation and release phases of an actuation cycle. The plots are then presented to the operator through the user interface for observation and analysis. These plots will be described in greater detail later through reference to FIGS. 7*c* and 8*c*.

Figure 5:
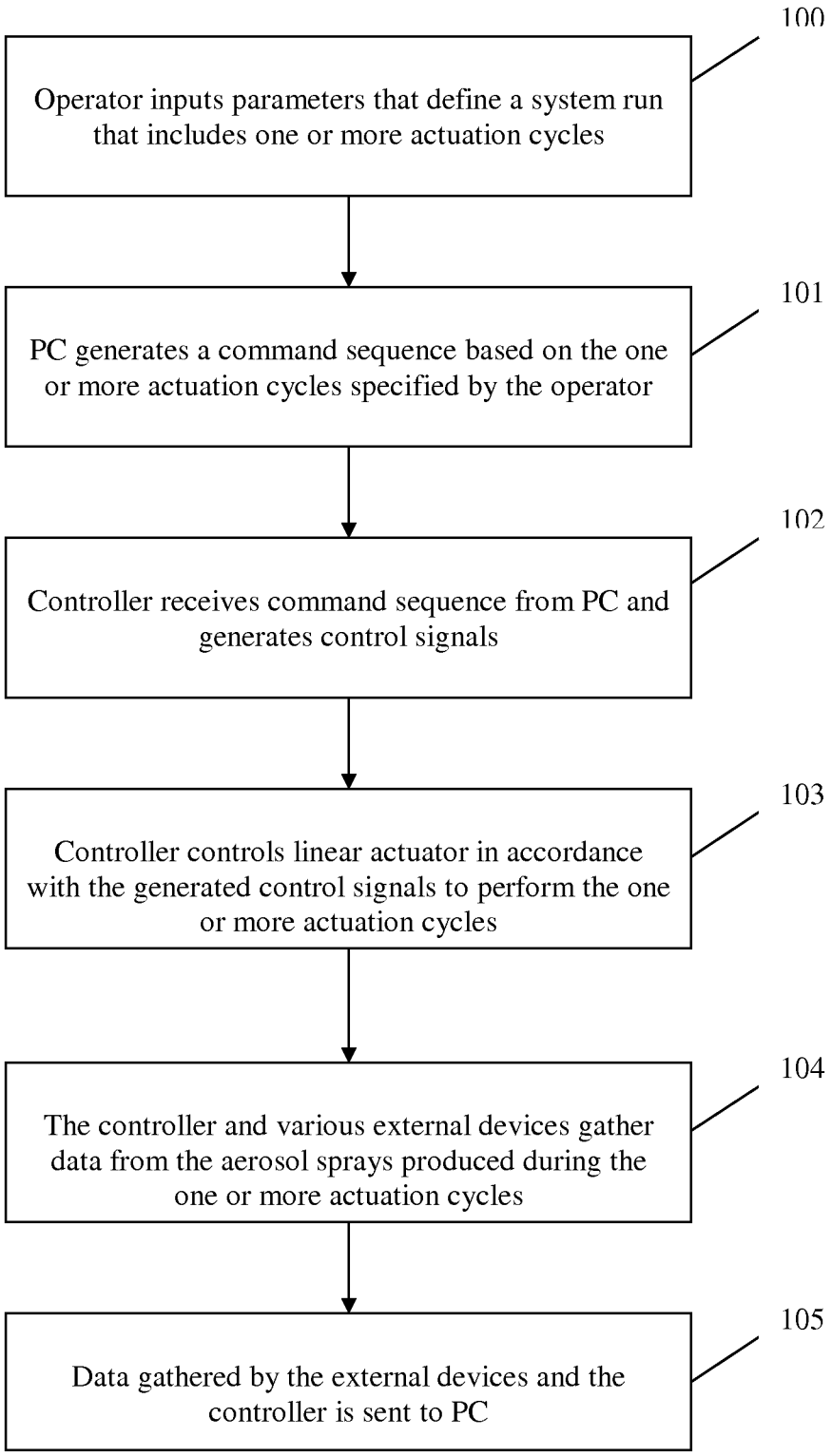
FIG. 5 is a process flow diagram in accordance with aspects of the present disclosure.

As described earlier, after the operator inputs the various parameters that define a system run, as shown in FIG. 5, in step 101, the personal computer generates a command sequence based on the system run specified by the operator. The command sequence is a series of commands that instructs the controller to control the apparatus depicted in FIGS. 1-3 to perform the one or more actuation cycles specified by the operator. The command sequence provides the controller with information regarding the various inputs specified by the operator (e.g. a number of actuation cycles to be performed in the run, an actuation velocity profile, a hold time, and a release velocity profile for each actuation cycle, and if applicable, an inter-spray delay time and a trigger signal delay time for each actuation cycle). In addition, the command sequence provides the controller with a control algorithm necessary to perform the one or more actuation cycles specified by the operator.

Figure 6:
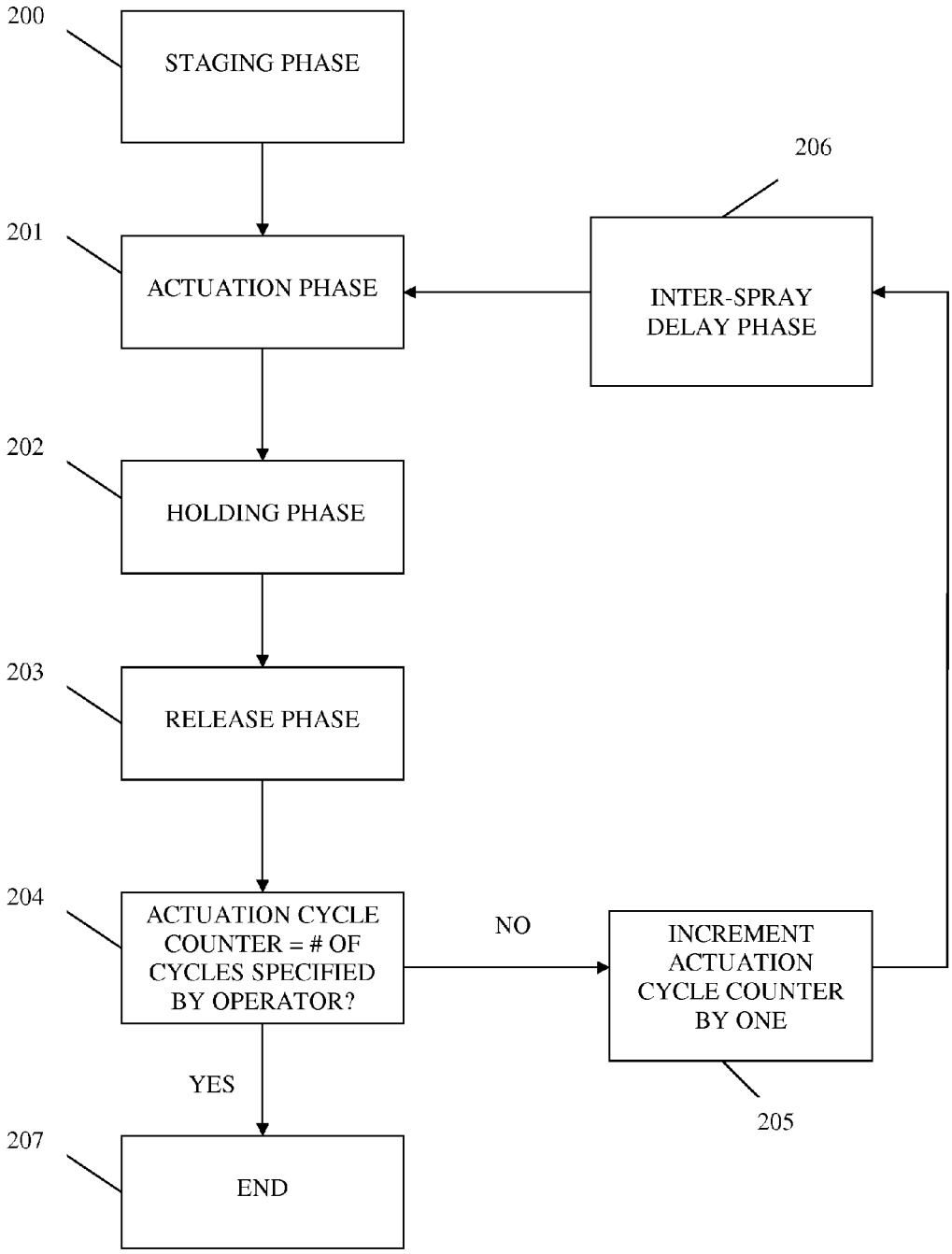
FIG. 6 is a control algorithm performed by a controller based on a command sequence in accordance with aspects of the present disclosure.

The control algorithm provided to the controller will now be described in greater detail through reference to FIG. 6. Prior to initiation of the system run, an actuation cycle counter is initialized to a value of 1. In step 200, the controller generates a control signal that instructs the apparatus to perform the staging phase of the first actuation cycle specified by the operator. During the staging phase, the forcer component of the linear motor is brought into contact with the aerosol spray device and the aerosol spray device is brought to a staging position.

In step 201, upon completion of the staging phase, the controller generates a control signal that instructs the apparatus to perform the actuation phase of the current actuation cycle. During the actuation phase, an actuation force is applied by the forcer component to the aerosol spray device in accordance with the velocity profile or the force profile specified by the operator for the current actuation cycle.

In step 202, upon completion of the actuation phase, the controller generates a control signal that instructs the apparatus to perform the holding phase of the current actuation cycle during which the aerosol spray device is maintained in the actuated position for the hold time specified by the operator and at the holding force specified for the current actuation cycle.

Upon completion of the holding phase, in step 203, the controller generates a control signal that instructs the apparatus to perform the release phase for the current actuation cycle. During the release phase, the actuation force applied to the aerosol spray device is removed in accordance with the velocity profile or force profile specified by the operator for the current actuation cycle such that the aerosol spray device moves from the actuated position to the staging position.

After completion of the release phase, the aerosol spray device has returned to the staging position. In step 204, the controller determines whether the actuation cycle counter equals the number (or is less than the number) of actuation cycles specified by the operator. If the controller determines that the actuation cycle counter does not equal the number of actuation cycles specified by the operator, the controller then increments the actuation cycle counter by one in step 205. Upon incrementing the counter in step 205, the control algorithm proceeds to step 206. In step 206, the controller generates a control signal that instructs the apparatus to perform an inter-spray delay phase. During the inter-spray delay phase, the apparatus maintains the aerosol spray device in the staging position for a period of time specified by the operator prior to initiation of the next actuation cycle. Upon completion of the inter-spray delay phase, the controller generates a control signal that instructs the apparatus to perform the actuation phase of the next actuation cycle.

The control algorithm then proceeds until the actuation cycle counter equals the number of actuation cycles specified for the system run that is currently being completed by the system. Referring back to step 204, if the controller determines that the actuation cycle counter equals the number of the actuation cycles specified by the operator, the control algorithm ends because the system run has completed.

As described earlier, the controller generates control signals that control the actuation and the release of the aerosol spray device during an actuation cycle in accordance with the velocity profile specified for that actuation cycle. Velocity measurements that represent an actual actuation velocity and/or release velocity are calculated based upon measurements by the linear encoder. These measurements are sent to the personal computer, which then generates plots of displacement vs. time for the actuation and release phases of an actuation cycle. The plots are then presented to the operator through the user interface for observation and analysis.

Figure 7A:
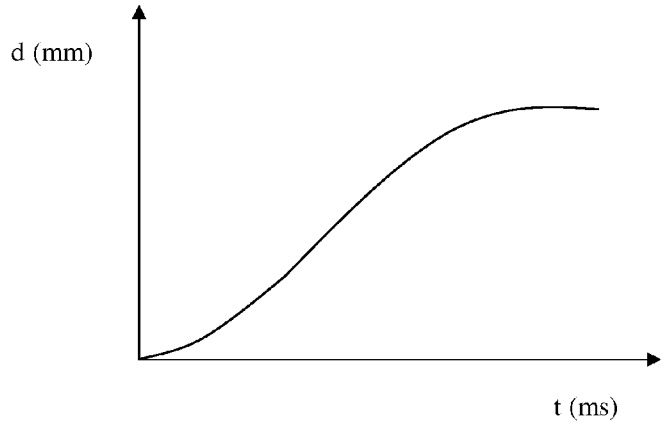
FIG. 7*a* is a plot of a constant velocity profile for an actuation phase in accordance with aspects of the present disclosure.
Figure 7B:
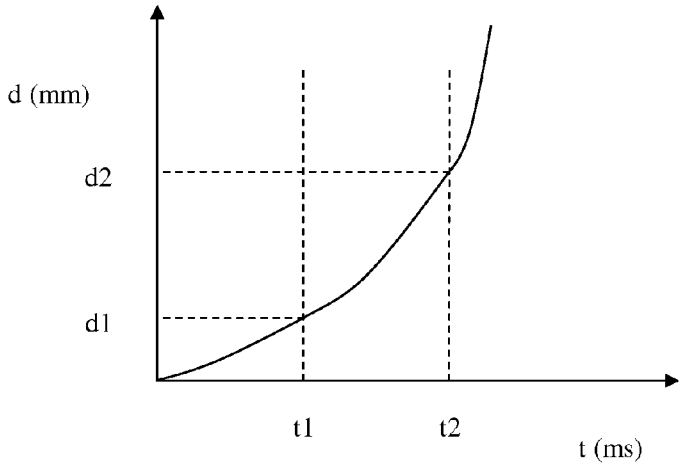
FIG. 7*b* is a plot of a velocity-step profile for an actuation phase in accordance with aspects of the present disclosure.
Figure 8A:
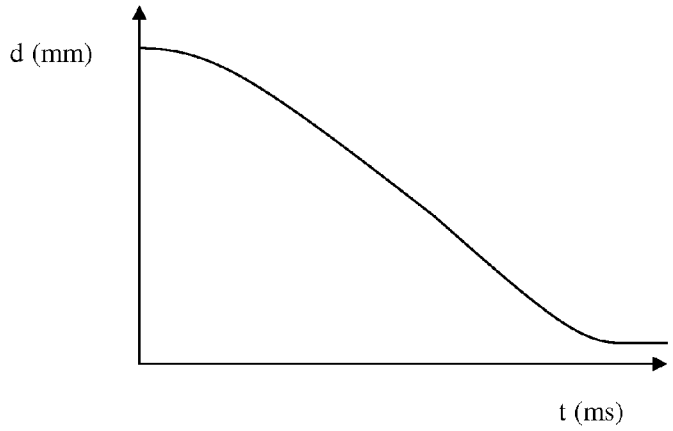
FIG. 8*a* is a plot of a constant velocity profile for a release phase in accordance with aspects of the present disclosure.
Figure 8B:
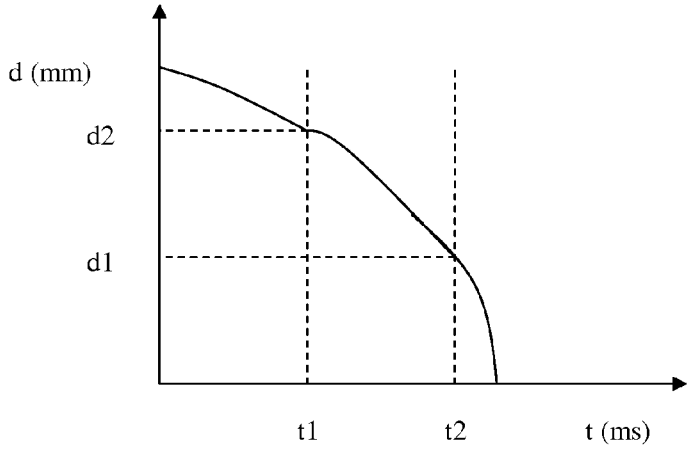
FIG. 8*b* is a plot of a velocity-step profile for a release phase in accordance with aspects of the present disclosure.

Sample plots are shown in FIGS. 7*a*-7*b* and 8*a*-8*b*. FIGS. 7*a* and 7*b* depict plots of displacement vs. time for actuation phases of an actuation cycle. FIGS. 8*a* and 8*b* depicts plots of displacement vs. time for release phases of an actuation cycle. The y-axis represents the actuation distance in mm and the x-axis represents a time of actuation in ms.

FIG. 7*a* corresponds to an actuation phase of an actuation cycle that includes a constant velocity profile. As shown in FIG. 7*a*, the start of the actuation phase includes a short acceleration period during which the velocity of actuation increases until the velocity specified by the constant velocity profile is reached. After the constant velocity is reached, the actuation proceeds at this velocity for substantially the entire actuation phase except for a short deceleration period at the end of the actuation phase.

FIG. 7*b* corresponds to an actuation phase of an actuation cycle that includes a velocity profile that comprises a series of velocity steps specified by the operator. As shown in FIG. 7*b*, the aerosol spray device is actuated at a first velocity until an actuation distance d1 is reached, and is subsequently actuated at a second velocity until an actuation distance d2 is reached. The step-wise velocity profile proceeds until the aerosol spray device reaches a fully actuated position or an actuation distance specified by the operator.

FIG. 8*a* corresponds to a release phase of an actuation cycle that includes a constant velocity profile. During the release phase, the aerosol spray device moves from the actuated position to the staging position. FIG. 8*a* depicts a constant velocity profile where the release velocity is constant over substantially the entire release phase except for short acceleration and deceleration phases at the start and end of the release phase.

FIG. 8*b* corresponds to a release phase of an actuation cycle that includes a velocity profile that comprises a series of velocity steps specified by the operator. As shown in FIG. 8*b*, the aerosol spray device is released from the actuated position at a first velocity until a release distance d1 is reached, and is subsequently released at a second velocity until a release distance d2 is reached. The step-wise velocity profile proceeds until the aerosol spray device reaches the staging position.

Figure 7C:
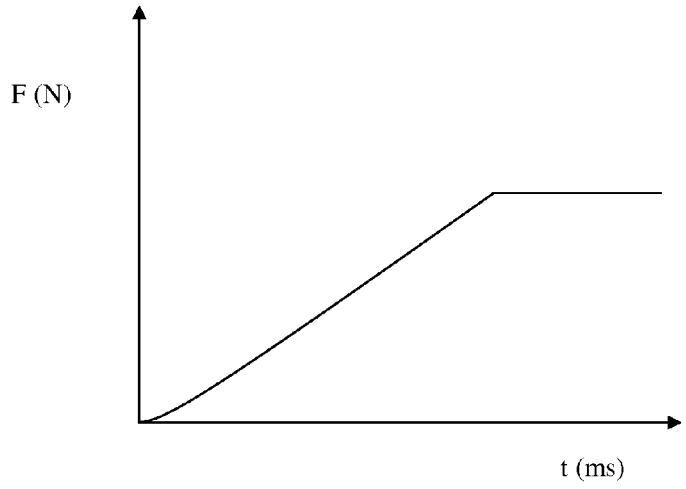
FIG. 7*c* is a plot of a force profile for an actuation phase in accordance with aspects of the present disclosure.
Figure 8C:
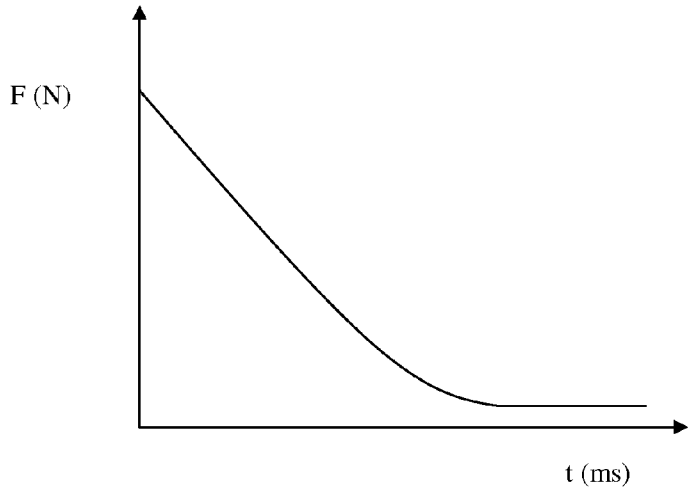
FIG. 8*c* is a plot of a force profile for a release phase in accordance with aspects of the present disclosure.

FIGS. 7*c* and 8*c* depict plots of force v. time for actuation and release phases, respectively, of an actuation profile. As shown in FIG. 7*c*, a linearly increasing actuation force is applied to the aerosol spray device until an actuation distance d1 specified by the operator is reached. In the alternative, the actuation force may be applied until an end of mechanical travel is reached.

FIG. 8*c* is a plot of force v. time for the release phase of an actuation cycle. During the release phase, the aerosol spray device moves from the actuated position to the staging position. FIG. 8*c* depicts a linearly decreasing force that is applied to the aerosol spray device until the device reaches the staging position.

While certain embodiments of the disclosed subject matter are described above, it should be understood that the disclosed subject matter can be embodied and configured in many different ways without departing from the spirit and scope of the disclosed subject matter.

While the invention has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A system for actuating a dispensing device, the system comprising:

an apparatus for holding and actuating the dispensing device, the apparatus including:

a linear motor including a stator component and a forcer component providing a direct linear force; and a frame that orients the components of the linear motor relative to each other and relative to the dispensing device;

the system further comprising:

a controller configured to control the linear motor; and a device that interfaces with the controller and provides a user interface for control of the system, wherein the controller is configured to generate control signals that cause the apparatus to perform at least one actuation cycle specified by an operator through the user interface provided by the device that communicates with the controller, the at least one actuation cycle includes:

an actuation phase during which an actuation force is applied by the forcer component to the dispensing device in a controlled manner;

a release phase during which the actuation force applied to the dispensing device is removed such that the dispensing device moves from an actuated position to a staging position; and at least one of a velocity profile that specifies a velocity of at least one of an actuation and a release of the dispensing device, and a force profile that specifies an actuation force to be applied to the dispensing device.

2. The system of claim 1, wherein the device that communicates with the controller generates a command sequence based on the at least one actuation cycle specified by the operator, sends the command sequence to the controller, and the controller generates signals based on the command sequence that cause the system to perform the at least one actuation cycle, the at least one actuation cycle further including:

a staging phase during which the forcer component is brought into contact with the dispensing device and the dispensing device is brought to the staging position; and a holding phase during which the dispensing device is maintained in the actuated position for a period of time determined by the operator.

3. The system of claim 2, wherein the controller generates control signals that cause the apparatus to perform a plurality of actuation cycles specified by the operator.

4. The system of claim 3, wherein the controller generates a control signal that causes the system to perform the staging phase only for an initial actuation cycle of the plurality of actuation cycles.

5. The system of claim 4, wherein the controller generates a control signal that causes the system to perform an inter-spray delay phase for each of the plurality of actuation cycles subsequent to the initial actuation cycle during which the dispensing device remains in the staging position for a period of time specified by the operator prior to initiation of a succeeding actuation cycle.

6. The system of claim 1, wherein the velocity profile is a constant velocity profile in which at least one of an actuation velocity and a release velocity of the dispensing device is substantially constant for a substantial portion of at least one of the actuation phase and the release phase.

7. The system of claim 1, wherein the velocity profile comprises a series of velocity steps specified by the operator, the dispensing device being actuated at a specified velocity over an actuation distance specified by the operator for each of the velocity steps until the dispensing device reaches the actuated position.

8. The system of claim 1, wherein the velocity profile comprises a series of velocity steps specified by the operator, the dispensing device being released from the actuated position at a specified velocity over a release distance specified by the operator for each of the velocity steps until the dispensing device reaches the staging position.

9. The system of claim 1, wherein the force profile specifies a linearly increasing force to be applied to the dispensing device during the actuation phase until an actuation distance specified by the operator is reached or the dispensing device reaches an end of mechanical travel.

10. The system of claim 9, further comprising:
a load cell transducer that includes:
a strain gauge; and
an amplifier,
wherein the strain gauge and amplifier operate together to measure the force applied to the dispensing device.

11. The system of claim 9, further comprising:
an ammeter that measures a current required by the linear motor,
wherein the force applied during actuation of the dispensing device is determined based on the measured current.

12. The system of claim 1, wherein the force profile specifies a linearly decreasing force to be applied to the dispensing device during the release phase until the dispensing device reaches the staging position.

13. The system of claim 1, further comprising:
a linear encoder that measures a distance moved over time.

14. The system of claim 13, wherein the controller generates control signals that control at least one of the actuation velocity and the release velocity in accordance with the velocity profile based on the velocity measured by the linear encoder.

15. The system of claim 1, wherein the device that communicates with the controller is a personal computer.

16. The system of claim 15, wherein the personal computer is connected to the controller through a serial communications port.

17. The system of claim 1, wherein the dispensing device is actuated over an actuation range of 0 to about 50 mm.

18. The system of claim 1, wherein:
the dispensing device is a nasal spray unit or a metered dose inhaler,
the nasal spray unit is actuated over an actuation range of about 2 mm to about 4 mm, and
the metered dose inhaler is actuated over an actuation range of about 4 mm to about 7 mm.

19. A method for actuating a dispensing device, the method comprising:
completing an actuation cycle specified by an operator, the actuation cycle including:
a staging step during which the dispensing device is contacted by a linear actuator and brought to a staging position;
an actuation step during which the dispensing device is actuated by the linear actuator;
a holding step during which the dispensing device is maintained in an actuated position for a period of time specified by the operator; and
a release step during which an actuation force applied by the linear actuator is removed so as to allow the dispensing device to move from the actuated position to the staging position.

20. A method for actuating a dispensing device, the method comprising:
completing a plurality of actuation cycles specified by an operator, the plurality of actuation cycles including an initial actuation cycle and at least one successive actuation cycle, the initial actuation cycle including:
a staging step during which the dispensing device is contacted by a linear actuator and brought to a staging position;
an actuation step during which the dispensing device is actuated by the linear actuator;
a holding step during which the dispensing device is maintained in an actuated position for a period of time specified by the operator; and
a release step during which an actuation force applied to the dispensing device by the linear actuator is removed so as to allow the dispensing device to move from the actuated position to the staging position; and
each of the at least one successive actuation cycles including:
an inter-spray delay step during which the dispensing device is maintained in the staging position for a period of time specified by the operator;
an actuation step during which the dispensing device is actuated by the linear actuator;
a holding step during which the dispensing device is maintained in the actuated position for a period of time specified by the operator; and
a release step during which an actuation force applied to the dispensing device by the linear actuator is removed so as to allow the dispensing device to move from the actuated position to the staging position.

21. A computer-readable recording medium storing a program for causing a controller to perform at least one actuation cycle specified by an operator for actuating a dispensing device, the program comprising instructions for performing a command sequence, the command sequence comprising:
a command to initialize an actuation cycle counter; and
a command to perform a staging step during which the dispensing device is contacted by a linear actuator and brought to a staging position, wherein on the condition that more than one actuation cycle is specified by the operator, the staging step is performed for only the first actuation cycle,
wherein on the condition that the actuation cycle counter does not equal a number of actuation cycles specified by the operator, the command sequence further comprises:
a command to perform an inter-spray delay step during which the dispensing device is maintained in the staging position for a period of time specified by the operator;
a command to perform an actuation step during which the dispensing device is actuated by the linear actuator;

a command to perform a holding step during which the dispensing device is maintained in an actuated position for a period of time determined by an operator; and a command to perform a release step during which an actuation force applied by the linear actuator is removed so as to allow the dispensing device to move from the actuated position to the staging position.

* * * * *